United States Patent [19]

Wilterdink

[11] 4,402,032

[45] Aug. 30, 1983

[54] ELECTROMAGNET POWER SUPPLY AND DEMAGNETIZER

[75] Inventor: Bernard W. Wilterdink, Claremont, N.H.

[73] Assignee: Cone-Blanchard Machine Company, Windsor, Vt.

[21] Appl. No.: 243,085

[22] Filed: Mar. 12, 1981

[51] Int. Cl.[3] ..... H01F 13/00

[52] U.S. Cl. ..... 361/145; 335/290; 361/149; 361/267

[58] Field of Search ..... 361/145, 143, 144, 149, 361/267; 335/289, 290

[56] References Cited

U.S. PATENT DOCUMENTS

| | | | |
|---|---|---|---|
| Re. 25,607 | 6/1964 | Littwin | 361/145 X |
| 3,532,940 | 10/1970 | Schroeder et al. | 361/149 |
| 3,872,626 | 3/1975 | White | 51/129 |

FOREIGN PATENT DOCUMENTS

| | | |
|---|---|---|
| 918076 | 2/1963 | United Kingdom . |
| 1166293 | 10/1969 | United Kingdom . |
| 1255210 | 12/1971 | United Kingdom . |
| 2069259 | 8/1981 | United Kingdom . |

*Primary Examiner*—Reinhard J. Eisenzopf
*Attorney, Agent, or Firm*—Kenway & Jenney

[57] ABSTRACT

An electronic current control device for energizing and de-energizing an electromagnet, such as a magnetic chuck, includes a DC power source preferably in the form of a phase-controlled SCR power unit. A conduction angle control signal is routed to positive or negative gates in the power unit to determine polarity and amplitude of direct current through the electromagnet windings. In the "on" mode an analog current feedback loop maintains a predetermined magnetizing level of current through the windings. In the demagnetize mode, a digital system decreases the current amplitude stepwise while alternating the polarity. When the sensed current attains the selected peak level for a given step, a digital count is decremented. The polarity is reversed according to the odd or even count, and a new peak reference level is established corresponding to the digital count.

9 Claims, 5 Drawing Figures

ELECTROMAGNET POWER SUPPLY AND DEMAGNETIZER

BACKGROUND OF THE INVENTION

The present invention relates generally to the automatic control of electric current flow through the windings of an electromagnet, and, in particular, to electronic demagnetization of magnetic chucks and the like.

Ferromagnetic material is characterized by a plurality of individually polarized magnetic domains. When the domains are all randomly oriented, the material will exhibit no net magnetism since the individual contributions of the domains cancel. On the other hand, when many domains are oriented in the same direction, the material acts as a magnet and is said to be magnetized. A ferromagnetic body may be magnetized by passing a direct electric current through coils wound around the body. The magnitude of the current determines the strength of the induced magnetization up to the point of saturation, at which all of the domains are similarly oriented.

Ferromagnetic materials exhibit a residual or permanent magnetism called hysteresis after the current inducing the magnetization is turned off. That is, while some of the domains lose their common orientation, others retain the induced polarity in the absence of the electrically generated magnetic field. Certain ferromagnetic materials exhibit this phenomenon to a far greater extent than others. Soft iron with high magnetic permeability, for example, retains far less residual magnetism than steel, for example.

The permanently magnetized material is difficult to demagnetize. Demagnetization requires a return to the randomly oriented domain condition. An electrically generated magnetic field has the opposite tendency: it tends to cause alignment of the domains. Thus, the material cannot be demagnetized by simply removing the current. Nor can it be demagnetized by applying a current in the opposite direction, as this would leave the material with residual magnetism in the opposite direction.

It has been found that for materials which exhibit substantial residual magnetism, demagnetization can be performed by using a sequence of successive reversals of current in the electrical windings while decreasing the current at each reversal. In this manner, a progressively smaller percentage of domains have their orientations switched back and forth. The result approximates a re-randomization of the orientation of the domains.

The many applications where electromagnets are used to attract or hold another ferromagnetic element or workpiece include magnetic cranes, chucks, clutches, molding apparatus, etc. Magnetic chucks for industrial abrasive grinding apparatus present an application of particular significance. In vertical rotary surface grinders of the type manufactured by the Cone-Blanchard Machine Company of Windsor, Vt., the assignee of the present application, the workpiece to be flat-ground is affixed to a rotating horizontal table. The workpiece is abraded by an overhead counter rotating grinding wheel exactly parallel to the surface of the rotating table. The table comprises a solid disc of steel with a perfectly flat polished horizontal surface. Coaxial electrical windings beneath the disc cause the entire rotating table to act as an electromagnet so as to attract and securely hold the ferromagnetic workpiece or workpieces to the top of the table while being ground.

The table is thus referred to as a rotary magnetic chuck and is capable of holding large and small workpieces of any configuration. Typical magnetic chucks in use today vary in diameter from sixteen inches to one hundred twenty inches.

The strength of the magnetic field should be adjustable to accommodate thick or thin workpieces and this can be relatively easily accomplished by providing adjustable direct current levels for the electromagnet windings. While requiring high magnetization on the one hand to hold rotating workpieces against the frictional and centrifugal forces experienced during the grinding process, the chuck must also be capable of substantially complete demagnetization in order to hold, reposition or remove the workpieces. Since the hardened steel used for the best magnetic chucks exhibits a significant degree of residual magnetism, thorough demagnetization becomes a difficult problem, particularly on the ten-foot diameter chucks.

In the past the successive reversal, decreasing current step technique has been used for magnetic chucks. In this type of control apparatus, the electric current is decreased in a sequence of steps by motor-driven switches which select taps on the transformer that powers the rectifier circuitry. The motor-driven switches include contacts that reverse the polarity in alternate steps. Since the load, i.e. the electromagnet windings, is inductive, each step involves a long exponential decay followed by a long exponential rise in current. The inductance associated with the windings for the larger chucks is high. And, since the voltage is reduced at each successive reversal, the time required to drive the current to the desired value at each step does not decrease substantially. Thus in such devices the timing of each step is usually fixed, and as a result each step must be excessively long to accommodate the effects of inductance. The prior device provides a demagnetization cycle which lasts on the order of a half a minute with the larger magnetic chucks. During this interval, the operator must wait before he can reposition the workpiece. On jobs calling for numerous repositionings of the workpiece, this delay can accumulate to the point where it substantially affects the production rate that this machinery can achieve. In summary, with known devices, it appears that the speed of the demagnetization cycle is constrained by (1) mechanical switching, (2) a fixed cycle and (3) inability to use as large a drive voltage as possible.

Furthermore, changing the number of reversals and/or the size of the current decrements at each step involves lengthy mechanical resettings or the availability of several devices set up for differing cycles or sequences. The cost of the relatively expensive transformer components and number of mechanical switches militates against these expedients.

SUMMARY OF THE INVENTION

Accordingly, the general purpose of the present invention is to permit faster, more flexible, and less expensive current control for energizing and de-energizing electromagnets. With this invention, current is controlled electronically and timed not arbitrarily but by sensing the actual current through the electromagnet windings. Demagnetization is achieved in a fraction of the time previously required. Electronic switching is used instead of motor-driven switching. The time required for each cycle is not fixed, but is determined by a current sensor which ends the cycle as soon as the proper current level has been reached, and the full driving voltage can be applied at each step regardless of the peak current level to be achieved.

According to the invention, power is supplied to the electromagnet windings of a magnetic chuck, for example, by a phase-controlled silicon controlled rectifier (SCR) power unit. A conduction angle signal is routed to the positive or negative gates in the power unit to determine the polarity and amplitude of direct current through the electromagnet windings. In the "on" mode, an analog current feedback loop maintains a predetermined magnetizing level of current through the windings. This level is adjustable but remains fixed during operation of the magnetic chuck. In the demagnetize mode, a digital system decreases the current amplitude stepwise while alternating the polarity. When the sensed current attains the selected peak level for a given step, a digital counter, preferably a presettable down counter, is decremented, reversing the polarity in accordance with the odd or even count and establishing a new preselected peak current reference level through an analog switch network connected to a bank of reference resistors. The selected reference resistance level corresponds to the digital value held in the counter. When the counter reaches zero, the demagnetization cycle is over.

The number of steps in the demagnetization routine is determined by the number preloaded into the counter. The decoding of the parallel counter outputs determines the demagnetizing cycle current profile. By an appropriate selection of resistors, any sequence of current levels may be achieved with a concomitant adjustment of time intervals for the steps. Thus, with the same control unit, the demagnetization current profile can be quickly tailored to suit different electromagnet requirements.

Finally, the use of standard, off-the-shelf, monolithic integrated circuit chips, and a small number of standard discrete circuit elements results in compact, low cost, reliable control circuitry.

DESCRIPTION OF THE PREFERRED EMBODIMENT

Figure 1:
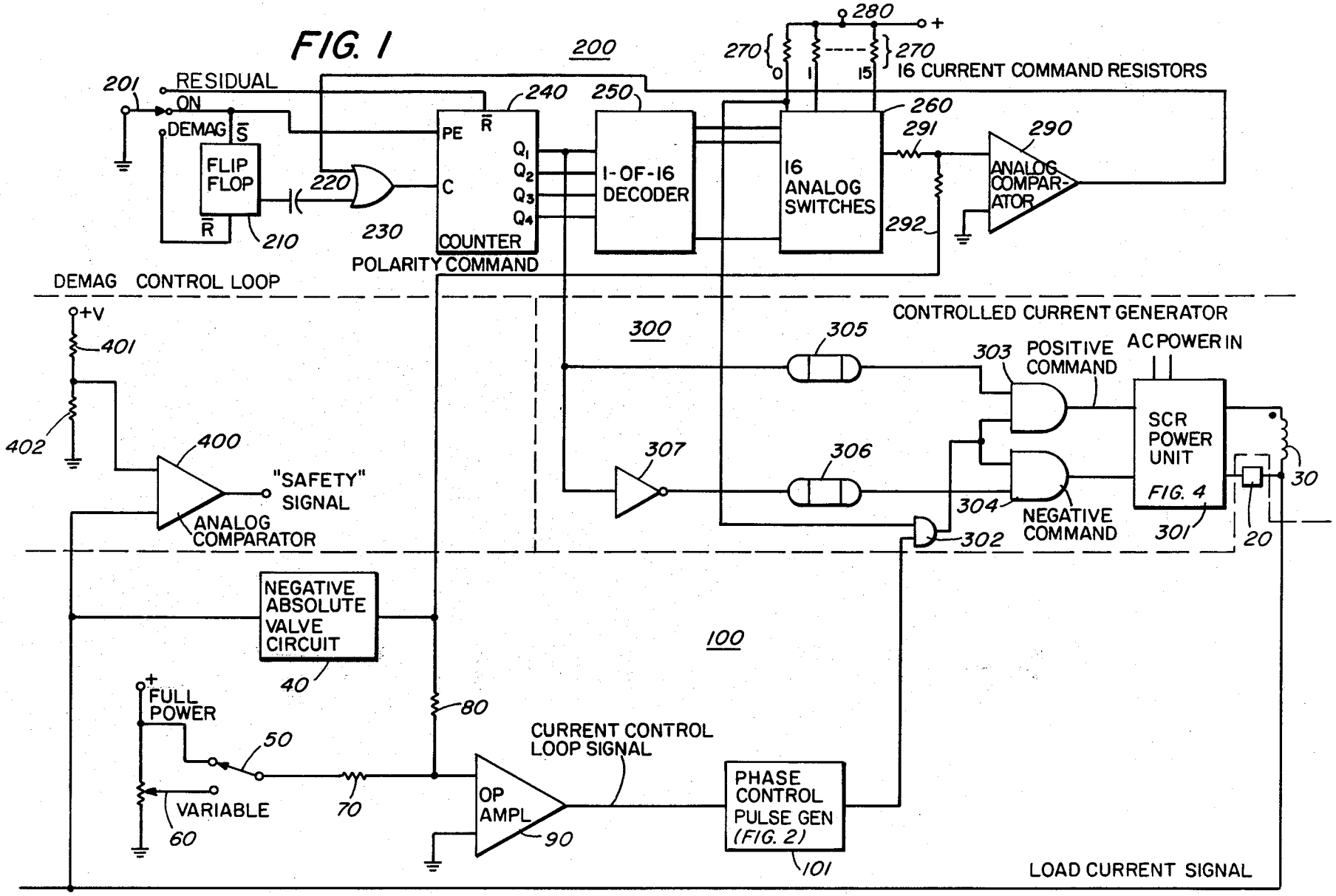
FIG. 1 is a functional block diagram of a preferred embodiment of the electromagnet power supply and demagnetizer according to the invention.

The system illustrated in FIG. 1 is specifically designed as the electromagnet power supply for a rotary magnetic chuck. The circuitry falls into three major functional sections: a current control loop 100, a demagnetization control loop 200, and a controlled current generator 300 including an SCR power unit 301 and associated command gating circuitry. The preferred embodiment employs a conventional bipolar phase-controlled SCR power unit 301 where the magnitude of the current output is determined by the phase angle of the input command pulses relative to AC power. The direction or polarity of the current depends on which of the two inputs, positive command and negative command, is pulsed. The amplitude command pulses are produced by the current control loop 100 while the polarity commands are furnished by the demagnetization control loop 200.

The device normally operates in either a current generation mode (i.e., "on" mode) or a demagnetization mode as selected by a mode switch 201. In the current generation mode, the current control loop 100 is operational. It consists of an analog current feedback loop in which the current 10 through the windings 30 is compared with the desired current to be generated as set by a switch 50 and a potentiometer 60. Appropriate command signals are generated by the pulse generator 101 and directed by the positive command gate to maintain the desired positive current through the load 30, namely the electromagnet windings.

In the demagnetization mode, both the current control loop 100 and the demagnetization control loop 200 operate. However, the current control loop 100 no longer functions strictly as a control loop because each desired demagnetization step current is less than the current generated during the "on" mode (i.e., full or variable power) and thus the actual current in the demagnetization mode starts toward, but never reaches the value called for by the switch 50 and the potentiometer 60. Instead, the rising current amplitude through the windings is compared with a series of preselected peak values represented by one of a set of current command resistors 270 in the demagnetization control loop. As the selected value of current for a given step is reached, a comparator 290 generates a signal causing a binary counter 240 to decrement its binary count. As the low-order bit $Q_1$ changes its logical state, a current reversal is accomplished by virtue of the SCR power unit gating circuitry. In addition, decrementing of the counter causes the next current command resistor, normally representing the next lower current step in the desired sequence, to be switched into place as a reference for the comparator 290. The demagnetization cycle is completed when the counter reaches zero after a predetermined number of current reversals and amplitude decrements. As the amplitude reference decreases, the step interval decreases accordingly.

We now proceed to a more detailed analysis of the circuit, starting with the current-control loop 100. The output current 10 is sensed by a resistor 20 in series with the load 30. This load current signal goes through a negative absolute value circuit 40 producing an output which is a negative voltage level proportional to the magnitude of the current 10 independent of its polarity.

The desired output current is established by means of the switch 50 and the potentiometer 60 which represent the desired current desired by a proportional voltage. The output of the absolute value circuit is compared to the desired current by way of scaling resistors 70 and 80 which cause the two (positive and negative) voltages to be summed by an operational amplifier 90. Thus, the operational amplifier 90 will have an output proportional to the difference between the desired and the actual current through the windings. The amplifier output is fed to a phase control pulse generator 101 to increase or decrease the conduction angle of commands supplied to the SCR power unit 301 relative to the AC line voltage waveform in order to maintain the desired value of current. Hence, while the power supply is in the "on" mode, the current output through the electromagnet is solely controlled by the setting of the desired current.

Figure 2:
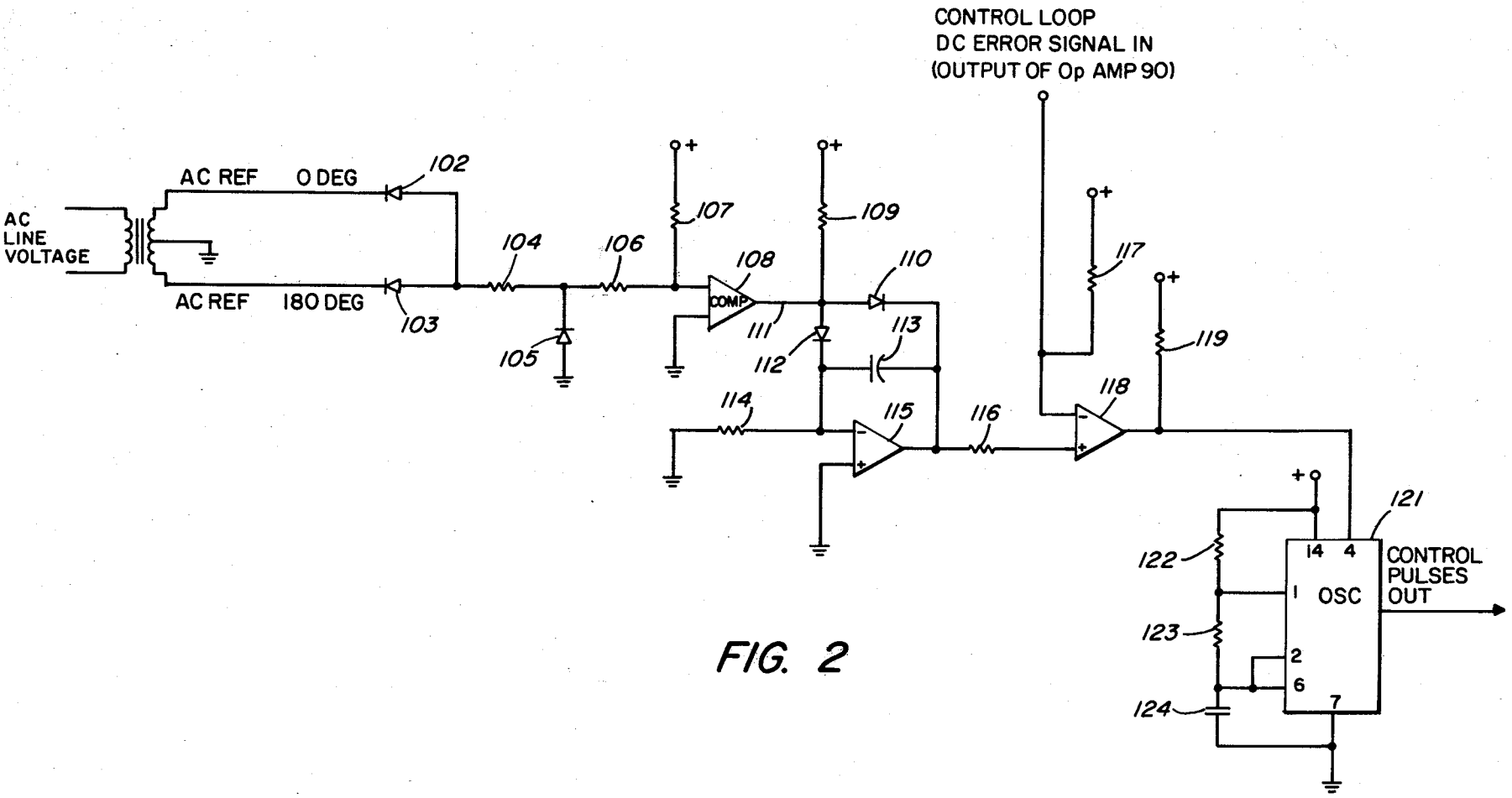
FIG. 2 is a detailed block and electrical schematic diagram of the phase control pulse generator of FIG. 1.

The purpose of the phase control pulse generator 101 is to convert the DC signal, representing the current control loop error signal output from the operational amplifier 90, into a phased chain of pulses which form a conduction angle signal for controlling the SCRs in the SCR power unit 301. As shown in FIG. 2, the pulse generator 101 includes integrated circuitry consisting of two analog comparators 108 and 118 (e.g., LM339), an operational amplifier 115 (e.g., LM348), and an RC oscillator 121 (e.g., CD556).

When either of the split phase AC reference voltages (FIG. 3) is negative, current is passed through one of the diodes 102 and 103 and the resistor 104. The nonlinear characteristic of the diodes results in the voltage waveform "A" in FIG. 3. For most of a half-cycle, this voltage, applied through resistor 106, to comparator 108, clamps the output 111 (waveform "B" in FIG. 3) of the comparator to ground. Near the voltage crossover points, the positive voltage applied through resistor 107 allows the output 111 to go high.

The function of comparator 108 and operational amplifier 115 is to generate a "ramp" signal (FIG. 3) consisting of a rising voltage during a half-cycle of the line voltage followed by a rapid drop to zero. This signal repeats every half-cycle and is precisely phased to the line voltage. This is accomplished by an operational amplifier 115 and its associated circuitry, a capacitor 113, and a resistor 114, forming an integrator cycled by the comparator 108. During the rising ramp portion of the waveform, the comparator output 111 is grounded and the diodes 110 and 112 are back-biased allowing the output of the operational amplifier 115 to rise at a rate determined by the capacitor 113 and the resistor 114. The integrator is scaled so that its output does not reach saturation. Twice each line voltage cycle, the comparator output 111 ("B", FIG. 3) goes high, swamping the negative voltage applied through the resistor 114 and simultaneously discharging the capacitor 113, driving the output of the operational amplifier 115 rapidly to zero. Furthermore, the diode 110 clamps the output at zero, preventing it from going negative.

Figure 3:
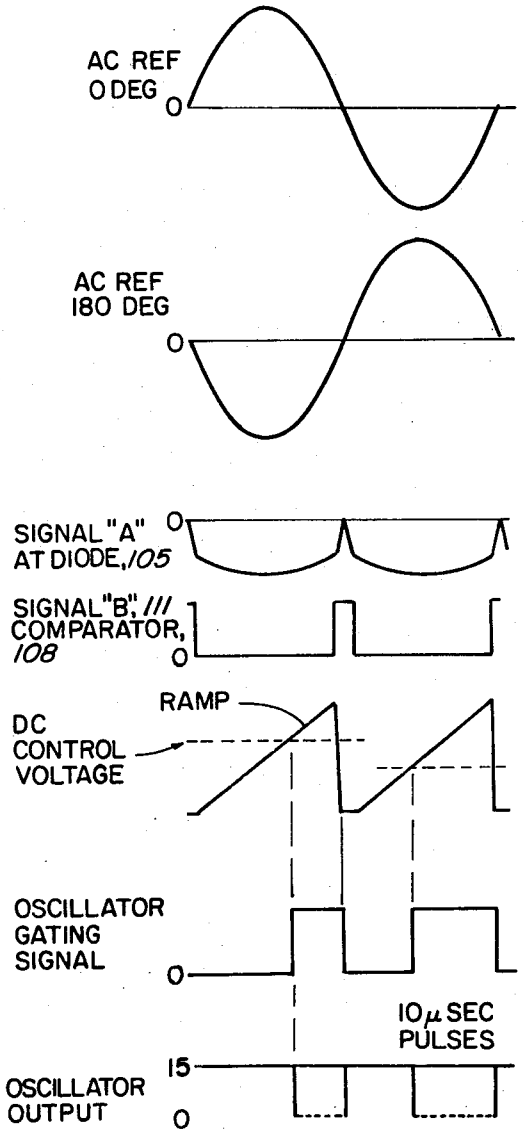
FIG. 3 is a timing diagram representing typical voltage waveforms present in the operation of the phase control pulse generator of FIG. 2.

The ramp waveform is compared by the comparator 118 to the DC error signal of the current control loop. As the error signal varies over the range of positive values, the trip point of this comparator will be shifted relative to the AC line voltage as represented by the ramp waveform. When the ramp signal reaches the value of the error signal, the comparator output switches from low to high turning on the oscillator 121. The output frequency (e.g., 8 KHz) and pulsewidth (e.g., 10 microsec.) of the oscillator 121 are determined by resistors 122 and 123 and capacitor 124. The oscillator turns off at the end of each half-cycle as the ramp signal falls back below the error signal. Thus, the oscillator is turned on each half-cycle for an interval determined by the error signal. The polarity of the error signal is such that the oscillator is turned on longer if the sensed current is too low and shorter if it is too high. FIG. 3 shows two successive DC current control error signals superimposed on the ramp signal, and the resultant change in the oscillator interval.

Figure 4:
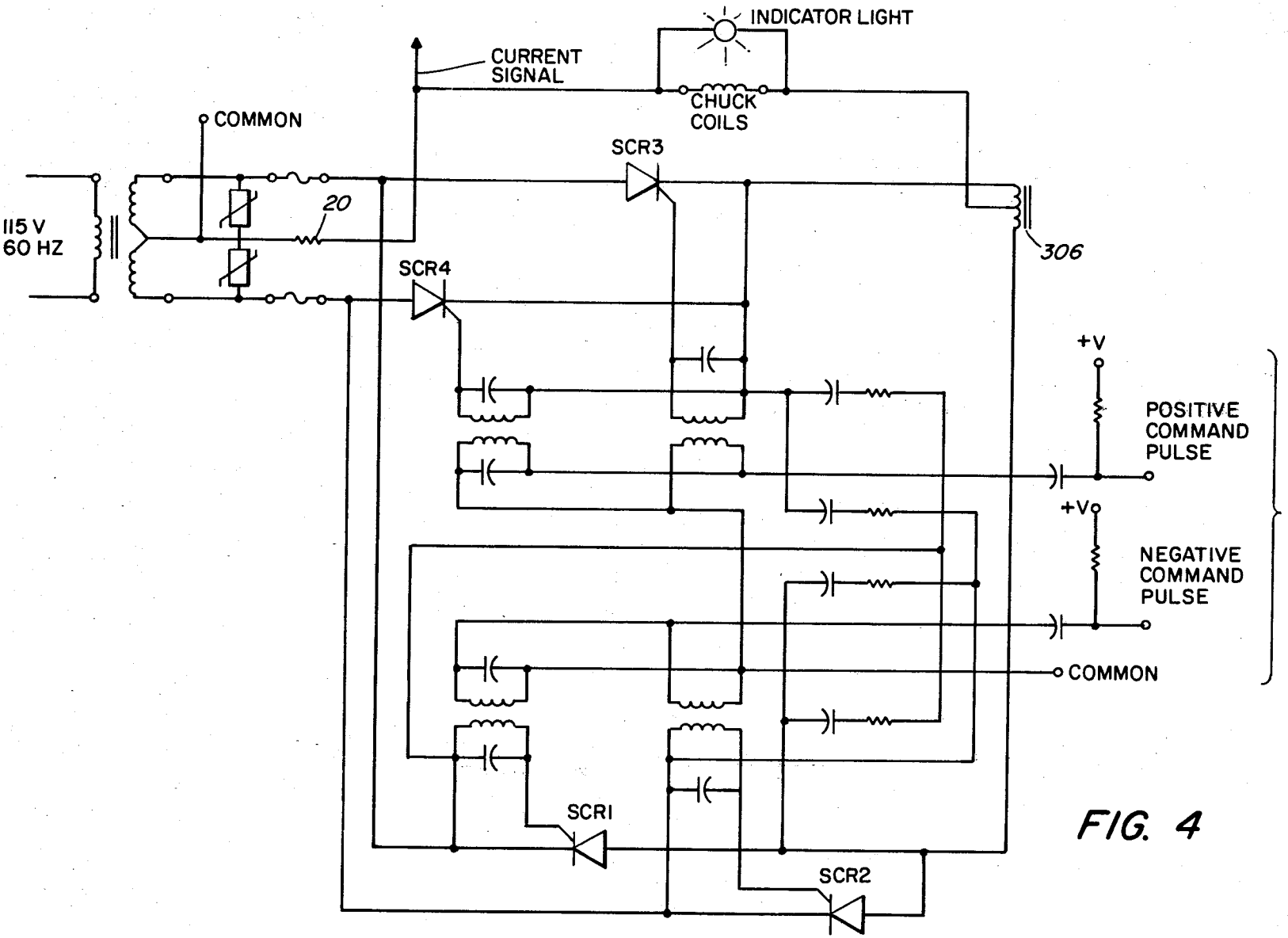
FIG. 4 is a schematic diagram of the SCR power unit of FIG. 1.

The output of the oscillator 121 forms the conduction angle output of the phase control pulse generator 101 (FIG. 1) and is fed via AND gate 302 and complementary AND gates 303 and 304 to the positive and negative command inputs to the SCR power unit 301. As shown in detail in FIG. 4, the SCR power unit 301 comprises a bipolar SCR inverter configuration for converting line voltage to direct current. The center tap of the secondary winding of the power supply transformer is connected in series with the sense resistor 20 and the magnetic chuck windings 30 via the center tap on a bilateral choke 306 to either end of the secondary winding via SCR 3 and SCR 4. SCR's 3 and 4 are connected for conduction in the same positive direction. Another pair of SCR's 1 and 2 is similarly connected to the chuck windings 30 for conduction in the opposite direction. All of the SCR's are normally nonconducting until they are turned on by the first oscillator pulse via the positive or negative command gate. When gated ON, either SCR 3 or SCR 4 will be conducting depending on whether a negative or positive half-cycle of line voltage is present. Once either SCR 3 or SCR 4 is turned on, by the first pulse in the oscillator pulse train from the phase control pulse generator, it will stay on. The additional pulses in the pulse train are not strictly necessary; however, the train of pulses gives added assurance that the SCR will not miss a half-cycle due to the high inductance of the circuit and where the absence of sufficient holding current after the first pulse. Similarly if the negative command gate is operative instead of the positive command gate, SCR's 3 and 4 will remain nonconductive while SCR's 1 and 2 will be gated. SCR's 1 and 2 are connected for conduction in the opposite direction. In a given half-cycle the respective one of the SCR's 1 and 2 will be conducting after it is gated ON as is the case for SCR's 3 and 4 in the positive mode.

When a demagnetization cycle is initiated by turning the mode switch 201 (FIG. 1) from ON to DEMAG, the current control loop 100 is still active but it never reaches a balanced condition because, as will be described below, the current is reversed at each step before the current can reach the value set by the switch 50 and the potentiometer 60.

While the mode switch 201 is in the ON position, the PRESET signal holds the binary counter 240 at a fixed odd number, typically 11 to 15. When the mode switch is moved to DEMAG, the preset enable-bar input of the counter goes high, disabling the PRESET inputs and allowing the counter to count down. At the same time, a pulse from the capacitor 220, generated as the flip-flop 210 changes state, pulses the clock input of the counter 240 causing it to count down by one. The low-order bit $Q_1$ of the counter 240 changes from "1" to "0" and immediately removes the positive command from the SCR power unit's positive command gate 303. A fraction of a second later the negative command gate 304 is activated, thereby changing the direction as well as magnitude of the current generated.

The positive and negative commands are mutually exclusive since they have as a common source, the $Q_1$ bit of the counter 240, but the input to the negative command is first passed through a logical inverter 307. The "on-delays" 305 and 306 cause a both-commands-off interval each time the low-order bit changes state. This interval is a fraction of a second and prevents damaging current from flowing through the SCR power unit at the transition from positive to negative, or the reverse.

Each "on-delay" 305, 306 is preferably implemented by using respectively the normal or inverted output of the $Q_1$ bit both to a trigger a one-shot and also to form one input to a two input AND gate, the other input to which is the normally high Q-bar output of the one-shot (not shown).

As the output current 10 passes through zero and increases in the negative direction, it is being sensed by the resistor 20 and subsequently translated into a negative voltage by the absolute value circuit 40. Besides its role in the current feedback loop 100, the output of circuit 40 also appears at the variable input of the analog comparator 290. At the same time, one of the current command resistors 270 has been switched in by the action of the 1-of-16 decoder 250 and the analog switching unit 260 as they monitor the parallel outputs of the binary counter 240. The value of the resistor thereby switched in is chosen so that in conjunction with the voltage source value 280, a fixed voltage-equivalent of the desired current level of this first step of demagnetization, appears at the reference input of the comparator 290.

When the output current reaches the desired current level of the first step, the comparator inputs become equal, which causes the comparator 290 to trip producing a second pulse to the binary counter 240 through OR gate 230, now making the count two less than the preset value. Since the low order bit 243 has now returned to logic "1", the SCR control is again through the positive command gate 303 and thus the current output through the electromagnet will be positive. The peak amplitude will be governed by the newly selected resistor 270.

Figure 5:
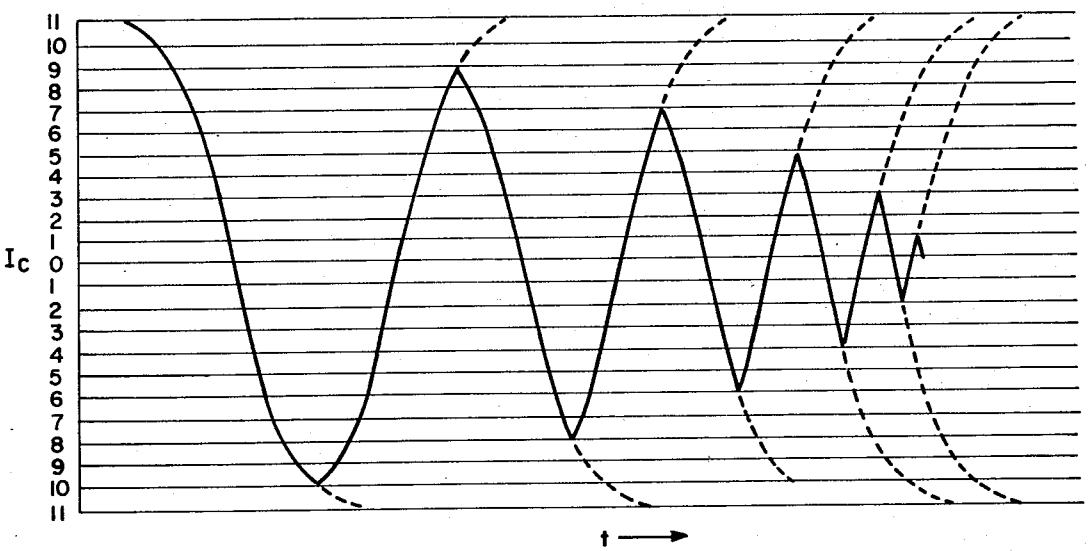
FIG. 5 is a graph representing a typical demagnetization current profile.

Each such decrement in counting is attended by the selection of a different current command resistor and reversal of polarity command. By choosing the resistors appropriately, any preselected sequence of current values of alternate polarity can be achieved. A typical sequence beginning from a preset count of eleven is illustrated in FIG. 5. Note that the step time intervals decrease because the current steps grow shorter.

When the binary counter 240 reaches zero, channel zero of the analog switches will become zero by being switched to the summing point of comparator 290 and blank the output of the phase control pulse generator 101 via gate 302. With no conduction angle signal to the SCR power unit 301, the output current through the electromagnet will remain at zero.

If the electromagnet has been energized and it is desired simply to turn off the current without going through the demagnetizer routine, the switch 201 can be turned to the residual setting whereby the counter is immediately reset to zero thus bypassing the demagnetization routine by grounding the reset-bar input to the counter 240.

For use with rotary magnetic chucks, a minimum safe current must be generated before starting rotation. Moreover, an interlock is required to prevent an accident, should the current fail. The load current signal may also be used to generate such a "safety" signal. A comparator 400 compares the actual current 10 being generated with a fixed signal representing the minimum safe current, thereby providing the "safety" signal. The resistors 401 and 402 are chosen, in conjunction with the applied voltage +V, to supply an appropriate reference signal.

In certain applications, if the variable power setting by potentiometer 60 is too low, the resulting error signal may be needlessly low during the demagnetizing routine. To insure that the operational amplifier 90 produces a substantial error signal during the demagnetizing cycle, a special positive offset or bias voltage may be summed with the other voltages at the input to the operational amplifier 90 during demagnetization mode. This can be implemented by connecting the appropriate output of the mode flip-flop 210 via a diode and series scaling resistor to the input of the operational amplifier 90.

For the purposes of simplification, the foregoing description is couched in terms of a maximum 16-term sequence of demagnetization cycles and successive reversals of the direction of the current. However, the invention applies equally well to any length sequence, and to arbitrary directions of current. Arbitrary sequences of current directions, rather than strictly successive reversal, can be achieved by interposing combinatorial logic elements between the output lines of the binary counter and the inputs to the command gates.

Because the actual current through the electromagnet windings is continuously sensed and magnetic flux induced by the electrical current is directly proportional to the current amplitude, the system represents an indirect means of flux control. Instead of applying an induced current and voltage to the windings for a preestablished time interval, the demagnetizer according to the invention applies full voltage for exactly the right length of time to reach a prescribed peak current for a given demagnetizing step before instantaneouly switching polarity. Once the correct demagnetizing routine has been selected for a given electromagnet, spurious changes in inductance of the load, due for example to workpieces of varying shapes, sizes and permeability, as well as changes in component values, will not interfere with the prescribed demagnetization cycle. Regardless of the time constant produced by the changing inductance values encountered in various applications, the peak current must still be reached in order for polarity reversal to occur. Thus the circuitry automatically adapts itself to changing circumstances. Because of its build-in flexibility, the power supply and demagnetizing circuit can accommodate a wide variety of electromagnet applications by proper choice of the preset number of steps and resistor values. Due to electronic switching and the application of full voltage to drive the winding current to the descending levels, the demagnetization time of prior art devices is improved by the present invention by a factor of up to about four.

While a particular preferred embodiment of the present invention has been illustrated in the accompanying drawing and described in detail herein, other embodiments are within the scope of the invention and the following claims.

What is claimed is:

1. In electromagnet control apparatus having a generator means for supplying direct current to the windings of an electromagnet and polarity switch means for switching the direction of said direct current on command, the improvement comprising a demagnetization system including means for producing a current feedback signal representing the instantaneous amplitude of the current flowing through said windings, register means for holding a digital value, means for selecting one of a plurality of current reference levels in accordance with the value held in said register means, comparator means for producing a control signal indicating that said current feedback signal level has attained a predetermined relationship to the selected current reference level, means responsive to said control signal for changing the value in said register means, and logic means responsive to a recurring first predetermined condition of the value held in said register means for operating said polarity switch means and to a final second predetermined condition of the value held in said register means for turning off said generating means.

2. The electromagnet control apparatus as set forth in claim 1, wherein the improvement further comprises initiation means for placing a predetermined value in said register meeting said first predetermined condition, whereby the polarity of direct current through the windings is reversed to begin demagnetization.

3. The electromagnet control apparatus as set forth in claim 2, wherein said first predetermined condition corresponds to the evenness or oddness of the numerical counterpart of the value held in said register means and said means for changing the value in said register means includes means for changing the present value in said register means by the number 1 in response to said control signal.

4. The electromagnet control apparatus as set forth in claim 3, wherein said means for changing the value by the number 1 includes means for decrementing the present value in said register means, said second predetermined condition corresponding to the value in said register means after being finally decremented to zero.

5. The electromagnet control apparatus as set forth in claim 4, wherein said means for selecting current reference levels includes a plurality of generally decreasing current reference levels corresponding to the succession of different values held in said register means as a result of successive control signals each indicative of the attainment of the preceding current reference level.

6. The electromagnet control apparatus as set forth in claim 5, wherein said register means includes a presettable digital down counter having a plurality of parallel ordered binary outputs, said means for operating said polarity switch means being responsive to the state of the lowest order binary output of said counter, and said means for selecting a plurality of current reference levels includes a predetermined number of current command resistors interconnected with the same number of analog switches and decoding means responsive to the output bits of said counter for actuating a corresponding one of said predetermined number of analog switches, said logic means responsive to said second predetermined condition including means connected to the output of said decoding means corresponding to the numerical value zero for producing an "off" signal to said generating means.

7. An electromagnet power supply and demangetizer system comprising:

bipolar electrical power generating means which includes phase controlled inverter means for providing direct current for a controlled conducting portion of each half-cycle of an alternating current supply to the winding of an electromagnet on command, current amplitude control means including means for producing a current feedback signal representing the instantaneous amplitude of current flowing through said winding, adjustable means for producing a current level command signal, comparing means for producing an error signal indicative of the difference between the current feedback signal level and the command signal level, said current amplitude control means including conduction angle signal generator means for producing in accordance with said error signal a control signal to said inverter means corresponding to the conducting portion of each half-cycle, means responsive to said error signal to cause said power generating means to deliver a higher or lower level of power to said windings so as to attempt to maintain the commanded current level, means for establishing a plurality of progressively decreasing peak current reference levels below said commanded current level, and demagnetization cycle means including means for initially reversing the polarity of said power generating means current through said windings and means for thereafter reversing the polarity of said direct current through said windings each time said current feedback signal attains a level corresponding to the next peak current reference level in said series of decreasing peak current reference levels, and means following the attainment by said current feedback signal of a level corresponding to the last peak current reference level in said series for turning off said current generating means.

8. The power supply and demagnetizer system of claim 7, wherein said inverting means includes a first pair of gate means for supplying positive direct current to said electromagnet windings and a second pair of gate means for producing negative direct current to said windings on command and a pair of mutually exclusive positive and negative command inputs to said gate means pairs respectively, logic means for passing the output of said conduction angle signal generator via said positive command input in the absence of said demagnetizing cycle, said demagnetizing cycle means having means for alternately routing of said conduction angle control signal to said negative and positive command inputs with each successive attainment of said current feedback signal of a level corresponding to a given one of said series of decreasing peak current reference levels.

9. The power supply and demagnetizer system as set forth in claim 8, wherein said demagnetizing cycle means further includes means for interrupting the passage of said conduction angle control signal for a predetermined interval before reversing the polarity of said direct current through said windings.

* * * * *